US008080947B2

(12) United States Patent
Chang et al.

(10) Patent No.: US 8,080,947 B2
(45) Date of Patent: Dec. 20, 2011

(54) CURRENT-SHARING TRANSFORMER AND POWER SUPPLY CIRCUIT HAVING SUCH CURRENT-SHARING TRANSFORMER

(75) Inventors: Shih-Hsien Chang, Taoyuan Hsien (TW); Po-Nien Ko, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 430 days.

(21) Appl. No.: 12/490,748

(22) Filed: Jun. 24, 2009

(65) Prior Publication Data

US 2010/0270945 A1 Oct. 28, 2010

(30) Foreign Application Priority Data

Apr. 27, 2009 (TW) ..... 98113930 A

(51) Int. Cl.
*H05B 41/16* (2006.01)

(52) U.S. Cl. ..... 315/282; 315/294

(58) Field of Classification Search ..... 315/224, 315/246, 274, 276, 282, 283, 294, 307
See application file for complete search history.

(56) References Cited

U.S. PATENT DOCUMENTS

| | | | | |
|---|---|---|---|---|
| 7,075,244 | B2 * | 7/2006 | Kang et al. | 315/212 |
| 7,196,483 | B2 * | 3/2007 | Wey et al. | 315/312 |
| 7,525,258 | B2 * | 4/2009 | Kim et al. | 315/282 |
| 7,893,629 | B2 * | 2/2011 | Yang et al. | 315/282 |
| 7,948,736 | B2 * | 5/2011 | Liu et al. | 361/268 |
| 2007/0152606 | A1 * | 7/2007 | Wey et al. | 315/274 |

* cited by examiner

*Primary Examiner* — Don Le
(74) *Attorney, Agent, or Firm* — Kirton & McConkie; Evan R. Witt

(57) ABSTRACT

A current-sharing transformer includes a magnetic core assembly, a primary winding coil and multiple secondary winding coils. The magnetic core assembly includes a main magnetic post and multiple minor magnetic posts. The primary winding coil is wound around the main magnetic post. The secondary winding coils wound around respective minor magnetic posts. The secondary winding coils are connected to respective DC loads through respective rectifier circuits. The magnetic paths between respective minor magnetic posts and the main magnetic post are equal, so that the magnitudes of currents passing through the DC loads are balanced by the current-sharing transformer.

20 Claims, 5 Drawing Sheets

CURRENT-SHARING TRANSFORMER AND POWER SUPPLY CIRCUIT HAVING SUCH CURRENT-SHARING TRANSFORMER

FIELD OF THE INVENTION

The present invention relates to a transformer, and more particularly to a current-sharing transformer for balancing the currents passing through the multiple DC loads. The present invention relates to a power supply circuit having such a current-sharing transformer.

BACKGROUND OF THE INVENTION

In recent years, light emitting diodes (LEDs) capable of emitting light with high luminance and high illuminating efficiency have been developed. In comparison with a common incandescent light, a LED has lower power consumption, long service life, and quick response speed. With the maturity of the LED technology, LEDs will replace all conventional lighting facilities. Until now, LEDs are widely used in many aspects of daily lives, such as automobile lighting devices, handheld lighting devices, backlight sources for LCD panels, traffic lights, indicator board displays, and the like.

Generally, the LED can be considered as a DC load. When an electronic device (e.g. a LCD panel) having multiple LED strings is operated, the currents passing through all LED strings shall be identical for a purpose of obtaining uniform brightness. Due to different inherent characteristics of these LED strings, the currents passing these LED strings are not identical and the brightness is usually not uniform. Therefore, the use life of individual LED string is shortened or even the whole electronic device has a breakdown.

For obtaining uniform brightness of multiple LED strings, several current sharing techniques have been disclosed. For example, as shown in FIG. 1, U.S. Pat. No. 6,621,235 disclosed a current sharing supply circuit for driving multiple LED strings. The current sharing supply circuit of FIG. 1 principally includes a linear regulator 11, a low-pass filter 12 and multiple current mirrors $M_1$~$M_n$. A constant reference current $I_{ref}$ is inputted into a first terminal of the linear regulator 11. The linear regulator 11 is controlled with the constant reference current $I_{ref}$ and thus an output voltage is generated and transmitted to the low-pass filter 12. The output voltage is filtered by the low-pass filter 12 and then transmitted to the gates of the current mirrors $M_1$~$M_n$. As a consequence, these current mirrors $M_1$~$M_n$, outputs identical currents. In other words, the LED strings linked to the current mirrors $M_1$~$M_n$ have the same current and brightness.

The conventional current sharing supply circuit for driving multiple LED strings, however, still has some drawbacks. For example, since the linear regulator and the current mirrors are employed, the conventional current sharing supply circuit has high power loss but low operating efficiency. In addition, since more components are used, the conventional current sharing supply circuit is very complicated.

There is a need of providing a current-sharing transformer so as to obviate the drawbacks encountered from the prior art.

SUMMARY OF THE INVENTION

An object of the present invention provides a current-sharing transformer for balancing the currents passing through the multiple DC loads.

Another object of the present invention provides a power supply circuit having such a current-sharing transformer, in which the power supply circuit has minimized power loss, high operating efficiency and simplified circuitry configuration.

In accordance with an aspect of the present invention, there is provided a current-sharing transformer. The current-sharing transformer includes a magnetic core assembly, a primary winding coil and multiple secondary winding coils. The magnetic core assembly includes a main magnetic post and multiple minor magnetic posts. The primary winding coil is wound around the main magnetic post. The secondary winding coils wound around respective minor magnetic posts. The secondary winding coils are connected to respective DC loads through respective rectifier circuits. The magnetic paths between respective minor magnetic posts and the main magnetic post are equal, so that the magnitudes of currents passing through the DC loads are balanced by the current-sharing transformer.

In accordance with another aspect of the present invention, there is provided a power supply circuit for driving multiple DC loads. The power supply circuit includes a switching circuit, a current-sharing transformer, and multiple rectifier circuits. The switching circuit is used for outputting an AC voltage. The current-sharing transformer is electrically connected to the switching circuit. The current-sharing transformer includes a magnetic core assembly, a primary winding coil and multiple secondary winding coils. The magnetic core assembly includes a main magnetic post and multiple minor magnetic posts. The primary winding coil is wound around the main magnetic post and electrically connected with the switching circuit for receiving the AC voltage. The secondary winding coils are wound around respective minor magnetic posts. The secondary winding coils generate AC induction currents according to electromagnetic induction between respective winding coils and the primary winding coil. The rectifier circuits are electrically connected to respective secondary winding coils and respective DC loads for rectifying the AC induction currents into corresponding DC voltages and outputting the DC voltages to respective DC loads. The magnetic paths between respective minor magnetic posts and the main magnetic post are equal, so that the magnitudes of currents passing through the DC loads are balanced by the current-sharing transformer.

The above contents of the present invention will become more readily apparent to those ordinarily skilled in the art after reviewing the following detailed description and accompanying drawings, in which:

DETAILED DESCRIPTION OF THE PREFERRED EMBODIMENT

Figure 1:
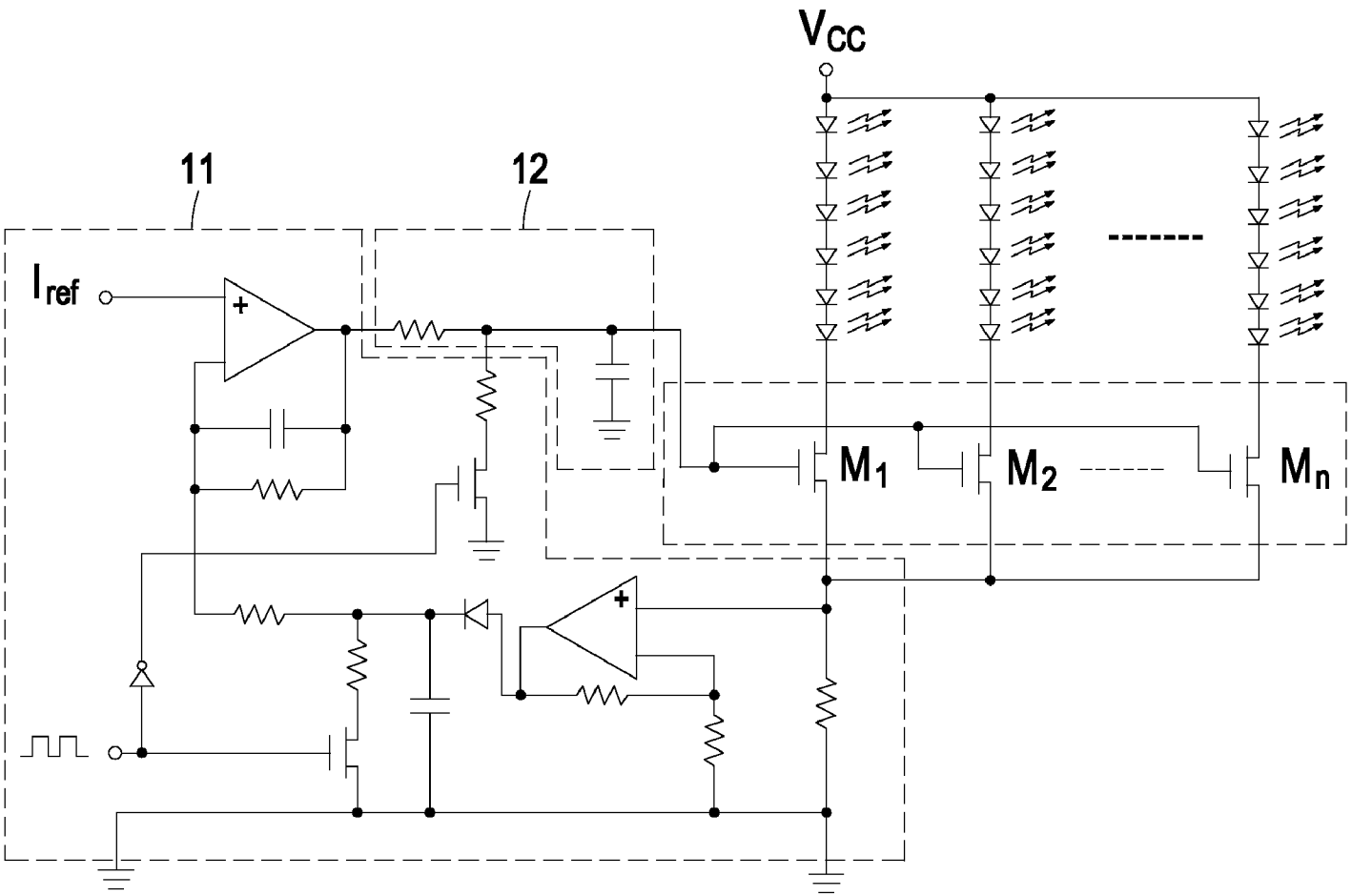
FIG. 1 PRIOR ART
FIG. 1 is a schematic circuit diagram of a current sharing supply circuit for driving multiple LED strings according to the prior art.

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

The present invention relates to a power supply circuit for driving multiple DC loads, so that all DC loads have the same brightness values. Examples of the DC loads are LED strings. Each LED string includes a plurality of LEDs. For clarification, each LED string having two LEDs is shown in the drawings.

Figure 2:
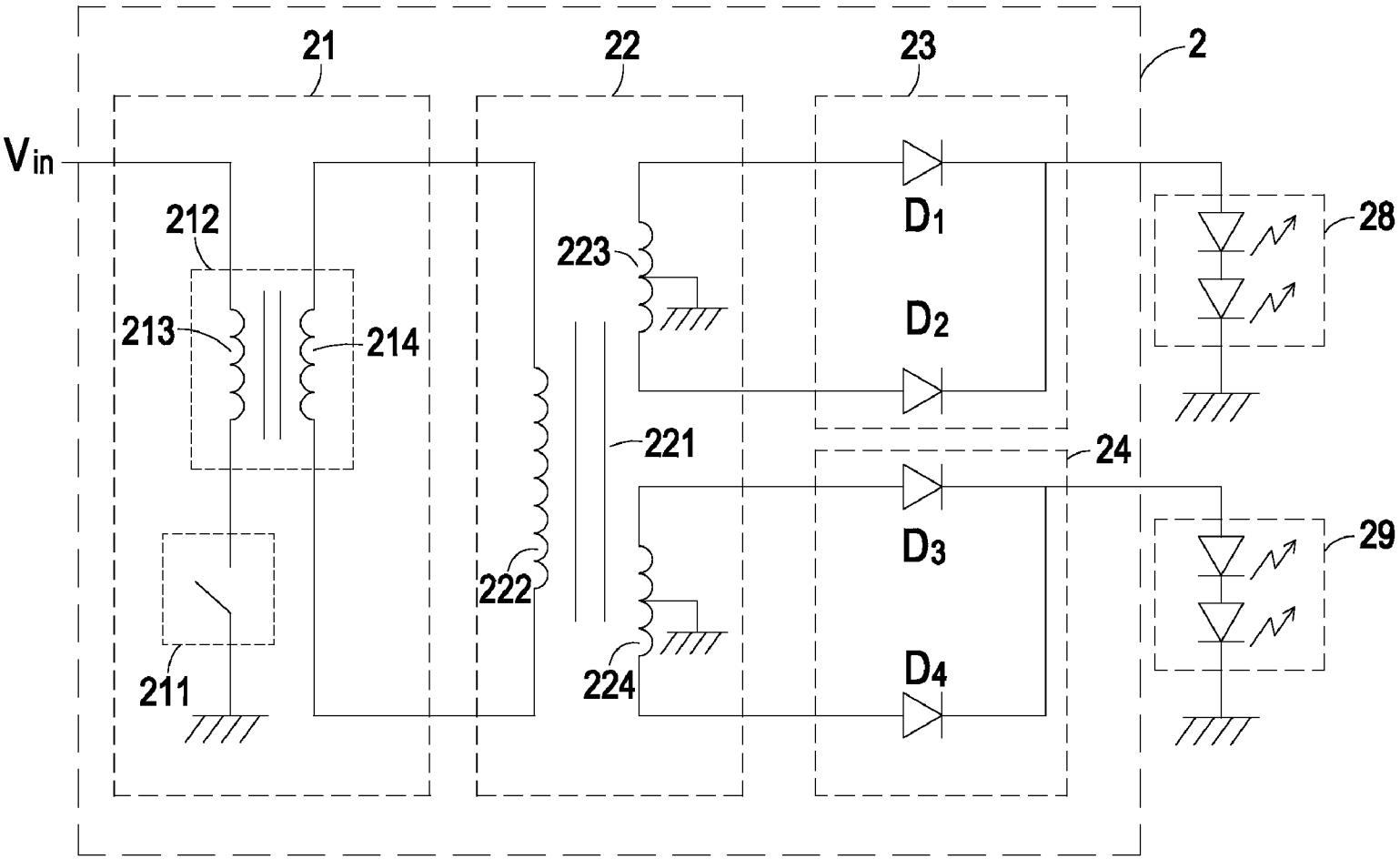
FIG. 2 is a schematic circuit block diagram of a power supply circuit having a current-sharing transformer according to an embodiment of the present invention.

FIG. 2 is a schematic circuit block diagram of a power supply circuit having a current-sharing transformer according to an embodiment of the present invention. As shown in FIG. 2, the power supply circuit 2 is electrically connected to multiple LED strings (e.g. a first LED string 28 and a second LED string 29). The power supply circuit 2 is used for providing DC currents for powering the first LED string 28 and the second LED string 29. In this embodiment, the power supply circuit 2 comprises a switching circuit 21, a current-sharing transformer 22 and multiple rectifier circuits (e.g. a first rectifier circuit 23 and a second rectifier circuit 24). In this embodiment, the first LED string 28 is electrically connected to the output terminal of the first rectifier circuit 23, and the second LED string 29 is electrically connected to the output terminal of the second rectifier circuit 24. The switching circuit 21 is used for outputting an AC voltage.

The current-sharing transformer 22 is electrically connected to the switching circuit 21, the first rectifier circuit 23 and the second rectifier circuit 24. The current-sharing transformer 22 is electrically connected to the first LED string 28 and the second LED string 29 through the first rectifier circuit 23 and the second rectifier circuit 24, respectively. The current-sharing transformer 22 comprises a magnetic core assembly 221, a primary winding coil 222 and multiple secondary winding coils (not shown). The magnetic core assembly 221 comprises a main magnetic post 225 and multiple minor magnetic posts (see FIG. 3). The primary winding coil 222 is wound around the main magnetic post 225. The secondary winding coils are wound around respective minor magnetic posts. The primary winding coil 222 is electrically connected to the output terminal of the switching circuit 21 for receiving the AC voltage that is outputted from the switching circuit 21. In this embodiment, the secondary winding coils comprise a first secondary winding coil 223 and a second secondary winding coil 224. The first secondary winding coil 223 and the second secondary winding coil 224 are electrically connected to the input terminals of the first rectifier circuit 23 and the second rectifier circuit 24, respectively. Due to the electromagnetic induction between the first secondary winding coil 223 and the primary winding coil 222, a first AC induction current is generated. Similarly, due to the electromagnetic induction between the second secondary winding coil 224 and the primary winding coil 222, a second AC induction current is generated. Since the magnetic paths between the main magnetic post 225 and respective minor magnetic posts are equal, the first AC induction current outputted from the first secondary winding coil 223 and the second AC induction current outputted from the second secondary winding coil 224 are equal. As a consequence, the current-sharing transformer 22 is capable of balancing the currents passing through the first LED string 28 and the second LED string 29.

The first rectifier circuit 23 and the second rectifier circuit 24 are used for rectifying the first AC induction current and the second AC induction current into a first DC current and a second DC current, respectively. The first DC current and a second DC current are respectively transmitted to the first LED string 28 and the second LED string 29, thereby illuminating the first LED string 28 and the second LED string 29. Since the DC currents passing through the first LED string 28 and the second LED string 29 are equal, the first LED string 28 and the second LED string 29 have the same brightness value.

Figure 3:
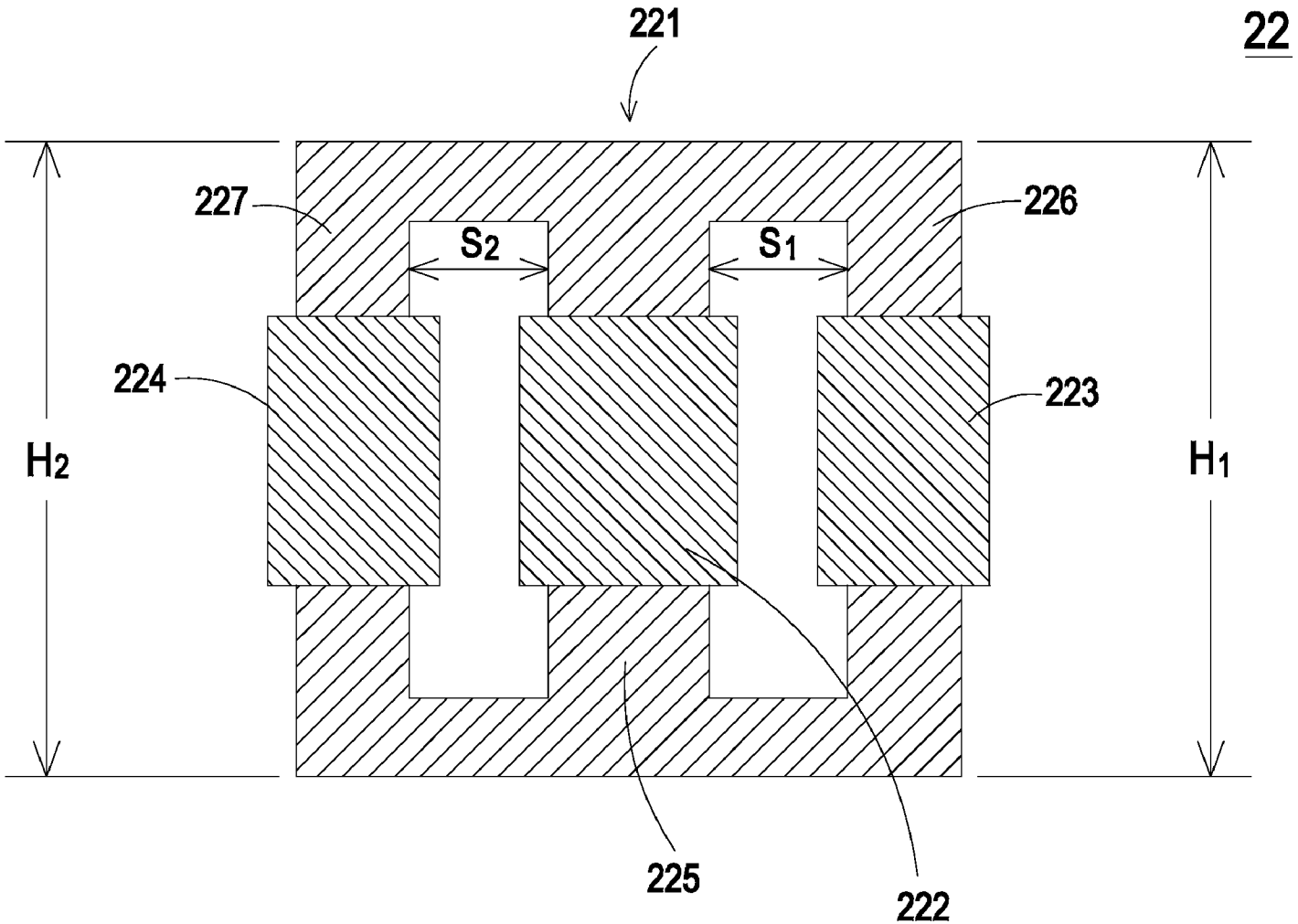
FIG. 3 is a schematic view illustrating the structure of the current-sharing transformer as shown in FIG. 2.

Hereinafter, the structure of the current-sharing transformer 22 will be illustrated with reference to FIGS. 3 and 2. FIG. 3 is a schematic view illustrating the structure of the current-sharing transformer as shown in FIG. 2. As shown in FIGS. 2 and 3, the current-sharing transformer 22 comprises the magnetic core assembly 221, the primary winding coil 222, the first secondary winding coil 223 and the second secondary winding coil 224. The magnetic core assembly 221 comprises the main magnetic post 225, a first minor magnetic post 226 and a second minor magnetic post 227. The primary winding coil 222 is wound around the main magnetic post 225. The first secondary winding coil 223 is wound around the first minor magnetic post 226. The second secondary winding coil 224 is wound around the second minor magnetic post 227. The first minor magnetic post 226 and the second minor magnetic post 227 are symmetrically arranged at bilateral sides of the main magnetic post 225. In other words, the spacing interval S1 between the first minor magnetic post 226 and the main magnetic post 225 is equal to the spacing interval S2 between the second minor magnetic post 227 and the main magnetic post 225. In addition, the length H1 of the first minor magnetic post 226 is equal to the length H2 of the second minor magnetic post 227, and the magnetic flux cross-section area of the first minor magnetic post 226 is equal to that of the second minor magnetic post 227.

Since the spacing interval S1 is equal to the spacing interval S2, the length H1 is equal to the length H2 and the magnetic flux cross-section area of the first minor magnetic post 226 is equal to that of the second minor magnetic post 227, the average length and average magnetic flux cross-section area of the first minor magnetic post 226 and the main magnetic post 225 are equal to those of the second minor magnetic post 227 and the main magnetic post 225. In other words, a first magnetic path between the first minor magnetic post 226 and the main magnetic post 225 is equal to a second magnetic path between the second minor magnetic post 227 and the main magnetic post 225. It is preferred that the main magnetic post 225, the first minor magnetic post 226 and the second minor magnetic post 227 are integrally formed. In addition, it is preferred that the coil turns of the first secondary winding coil 223 and the second secondary winding coil 224 are identical.

Hereinafter, the principle of achieving the current-sharing purpose by the current-sharing transformer 22 will be illustrated in more details with reference to FIGS. 2 and 3. When the power supply circuit 2 is enabled, an AC voltage outputted from the switching circuit 21 is transmitted to the primary winding coil 222 of the current-sharing transformer 22. Meanwhile, the main magnetic post 225 has a first magnetic flux density, the first minor magnetic post 226 has a second magnetic flux density, and the second minor magnetic post 227 has a third magnetic flux density. Since the first magnetic path between the first minor magnetic post 226 and the main magnetic post 225 is equal to the second magnetic path between the second minor magnetic post 227 and the main magnetic post 225, each of the second magnetic flux density and the third magnetic flux density is equal to a half of the first magnetic flux density. As previously described, the average length and average magnetic flux cross-section area of the first minor magnetic post 226 and the main magnetic post 225 are equal to those of the second minor magnetic post 227 and the main magnetic post 225, and the coil turns of the first secondary winding coil 223 and the second secondary winding coil 224 are identical. As such, the first AC induction current outputted from the first secondary winding coil 223 and the second AC induction current outputted from the second secondary winding coil 224 are equal according to Ampere's circuital law and Ohm's law. Since the DC currents passing through the first LED string 28 and the second LED string 29 are balanced by the current-sharing transformer 22, the first LED string 28 and the second LED string 29 have the same brightness value.

Please refer to FIG. 2 again. The switching circuit 21 comprises at least one switch element 211 and an isolation transformer 212. The isolation transformer 212 comprises a primary winding coil 213 and a secondary winding coil 214. The primary winding coil 213 is electrically connected to the switch element 211 and receives an input voltage $V_{in}$. The secondary winding coil 214 is electrically connected to the primary winding coil 222 of the current-sharing transformer 22. According to the actions of the switch element 211, the input voltage $V_{in}$ is converted into an AC voltage, which is transmitted to the primary winding coil 222 of the current-sharing transformer 22. The configuration of the switching circuit 21 is not restricted as long as the switching circuit is able to output an AC voltage according to the actions of the switch element included in the switching circuit.

Please refer to FIG. 2 again. The first rectifier circuit 23 comprises at least one diode (e.g. a first diode $D_1$ and a second diode $D_2$). The anodes of the first diode $D_1$ and the second diode $D_2$ are respectively connected to both terminals of the first secondary winding coil 223 of the current-sharing transformer 22. The cathodes of the first diode $D_1$ and the second diode $D_2$ are collectively connected to the first LED string 28. The second rectifier circuit 24 also comprises at least one diode (e.g. a third diode $D_3$ and a fourth diode $D_4$). The anodes of the third diode $D_3$ and the fourth diode $D_4$ are respectively connected to both terminals of the second secondary winding coil 224 of the current-sharing transformer 22. The cathodes of the third diode $D_3$ and the fourth diode $D_4$ are collectively connected to the second LED string 29.

Figure 4:
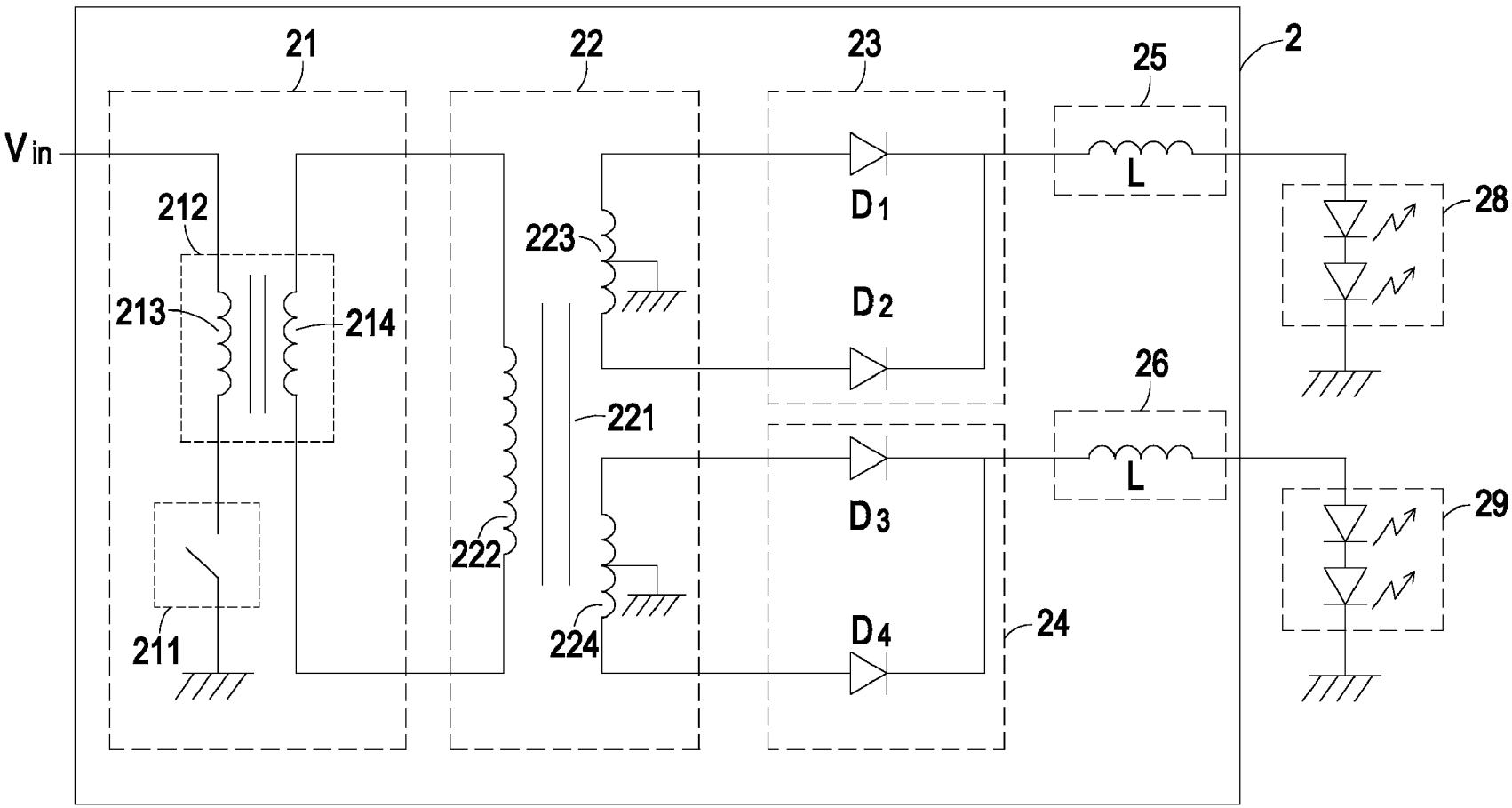
FIG. 4 is a schematic circuit block diagram of a power supply circuit having a current-sharing transformer according to another embodiment of the present invention.

FIG. 4 is a schematic circuit block diagram of a power supply circuit having a current-sharing transformer according to another embodiment of the present invention. The power supply circuit 2 further comprises multiple filtering circuits (e.g. a first filtering circuit 25 and a second filtering circuit 26). The first filtering circuit 25 is serially connected between the first rectifier circuit 23 and the first LED string 28. The second filtering circuit 26 is serially connected between the second rectifier circuit 24 and the second LED string 29. The first filtering circuit 25 and the second filtering circuit 26 are respectively used for filtering the DC voltages that are outputted from the first rectifier circuit 23 and the second rectifier circuit 24. In an embodiment, each of the first rectifier circuit 23 and the second rectifier circuit 24 includes an inductor L. Alternatively, each of the first rectifier circuit 23 and the second rectifier circuit 24 includes a capacitor, multiple capacitors or multiple inductors.

Figure 5:
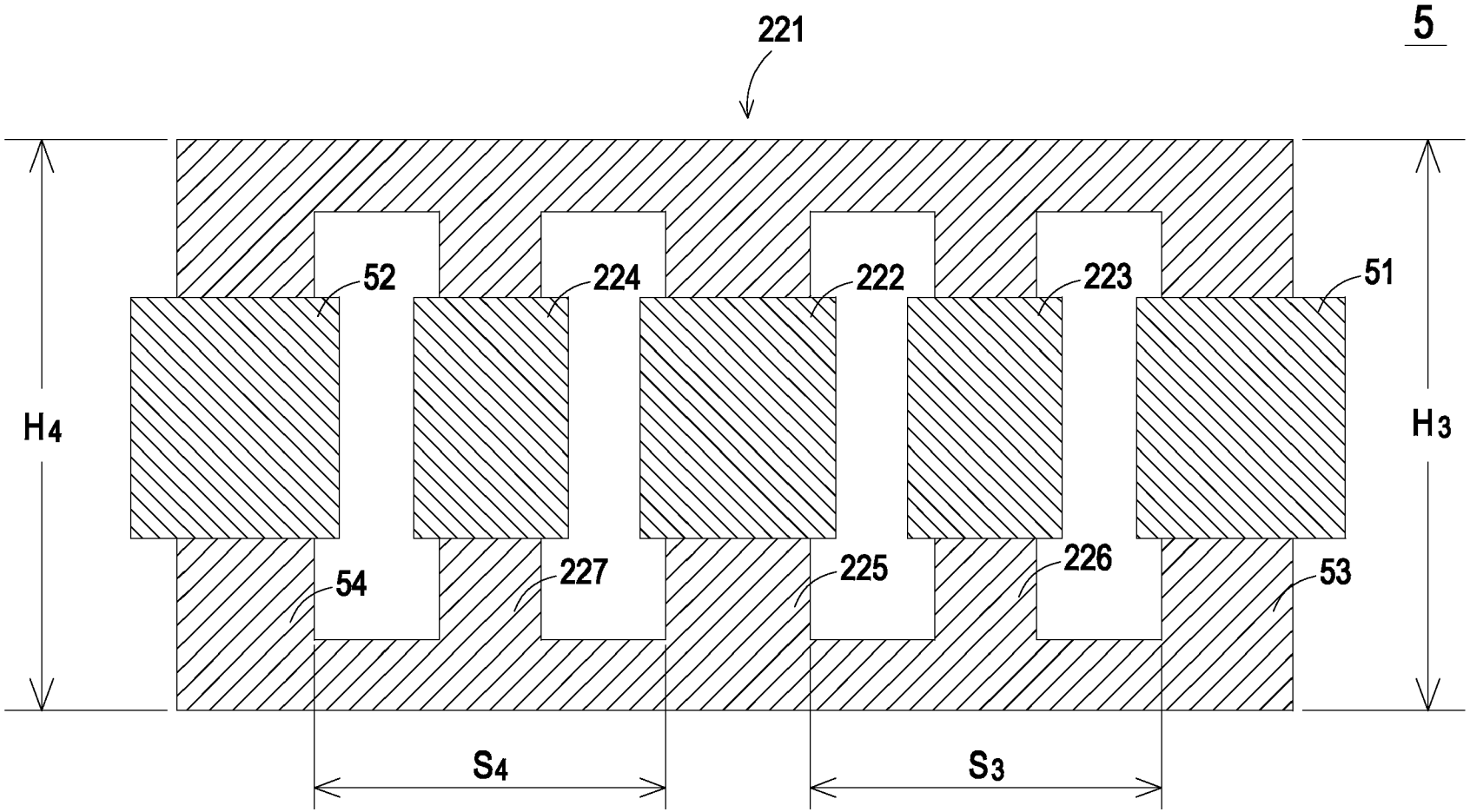
FIG. 5 is a schematic view illustrating a variant of the current-sharing transformer as shown in FIG. 3.

FIG. 5 is a schematic view illustrating a variant of the current-sharing transformer as shown in FIG. 3. In comparison with the current-sharing transformer 22 of FIG. 3, the current-sharing transformer 5 of FIG. 5 have more minor magnetic posts, so that more secondary winding coils could be wound around the minor magnetic posts. In other words, the current-sharing transformer 5 of FIG. 5 can be used to balance the DC currents passing through more LED strings.

Hereinafter, the structure of the current-sharing transformer 5 will be illustrated in more details. As shown in FIG. 5, the magnetic core assembly 221 of the current-sharing transformer 5 comprises a main magnetic post 225, a first minor magnetic post 226, a second minor magnetic post 227, a third minor magnetic post 53 and a fourth minor magnetic post 54. Corresponding to the third minor magnetic post 53 and the fourth minor magnetic post 54, the current-sharing transformer 5 further comprises a third secondary winding coil 51 and a fourth secondary winding coil 52. The third secondary winding coil 51 is wound around the third minor magnetic post 53. The fourth secondary winding coil 52 is wound around the fourth minor magnetic post 54. The third minor magnetic post 53 and the fourth minor magnetic post 54 are symmetrically arranged at bilateral sides of the main magnetic post 225. In addition, the first minor magnetic post 226 is arranged between the main magnetic post 225 and the third minor magnetic post 53, and the second minor magnetic post 227 is arranged between the main magnetic post 225 and the fourth minor magnetic post 54. Since the third minor magnetic post 53 and the fourth minor magnetic post 54 are symmetrically arranged at bilateral sides of the main magnetic post 225, the spacing interval S3 between the third minor magnetic post 53 and the main magnetic post 225 is equal to the spacing interval S4 between the fourth minor magnetic post 54 and the main magnetic post 225. In addition, the length H1 of the first minor magnetic post 226, the length H2 of the second minor magnetic post 227, the length H3 of the third minor magnetic post 53 and the length H4 of the fourth minor magnetic post 54 are equal. Moreover, the magnetic flux cross-section area of the third minor magnetic post 53 is equal to that of the fourth minor magnetic post 54.

Since the spacing interval S3 is equal to the spacing interval S4, the length H3 is equal to the length H4 and the magnetic flux cross-section area of the third minor magnetic post 53 is equal to that of the fourth minor magnetic post 54, the average length and average magnetic flux cross-section area of the third minor magnetic post 53 and the main magnetic post 225 are equal to those of the fourth minor magnetic post 54 and the main magnetic post 225. In other words, a third magnetic path between the third minor magnetic post 53 and the main magnetic post 225 is equal to a fourth magnetic path between the fourth minor magnetic post 54 and the main magnetic post 225.

Since the first minor magnetic post 226 is arranged between the main magnetic post 225 and the third minor magnetic post 53 and the second minor magnetic post 227 is arranged between the main magnetic post 225 and the fourth minor magnetic post 54, the average length of the magnetic path between the third minor magnetic post 53 (or the fourth minor magnetic post 54) and the main magnetic post 225 is greater than the average length of magnetic path between the first minor magnetic post 226 (or the second minor magnetic post 227) and the main magnetic post 225. For allowing the magnetic path between the third minor magnetic post 53 (or the fourth minor magnetic post 54) and the main magnetic post 225 to be equal to the magnetic path between the first minor magnetic post 226 (or the second minor magnetic post 227) and the main magnetic post 225, the magnetic flux cross-section area of the third minor magnetic post 53 (or the fourth minor magnetic post 54) is greater than the magnetic flux cross-section area of the first minor magnetic post 226 (or the second minor magnetic post 227). In addition, the magnetic flux cross-section area of the third minor magnetic post 53 (or the fourth minor magnetic post 54) is in direct proportion to the difference between the magnetic path length from the third minor magnetic post 53 to the main magnetic post 225 and the magnetic path length from the first minor magnetic post 226 to the main magnetic post 225. Alternatively, the magnetic flux cross-section area of the third minor magnetic post 53 (or the fourth minor magnetic post 54) is in direct proportion to the difference between the magnetic path length from the fourth minor magnetic post 54 to the main magnetic post 225 and the magnetic path length from the second minor magnetic post 227 to the main magnetic post 225. As such, the average magnetic flux cross-section area of the magnetic path between the third minor magnetic post 53 and the main magnetic post 225 or the average magnetic flux cross-section area of the magnetic path between the fourth minor magnetic post 54 and the main magnetic post 225 is greater than the average magnetic flux cross-section area of the magnetic path between the first minor magnetic post 226 and the main magnetic post 225 or the average magnetic flux cross-section area of the magnetic path between the second minor magnetic post 227 and the main magnetic post 225. In other words, the magnetic path between the third minor magnetic post 53 (or the fourth minor magnetic post 54) and the main magnetic post 225 is substantially identical to the magnetic path between the first minor magnetic post 226 (or the second minor magnetic post 227) and the main magnetic post 225.

It is preferred that the main magnetic post 225, the first minor magnetic post 226, the second minor magnetic post 227, the third minor magnetic post 53 and the fourth minor magnetic post 54 are integrally formed. In addition, it is preferred that the coil turns of the first secondary winding coil 223, the second secondary winding coil 224, the third secondary winding coil 51 and the fourth secondary winding coil 52 are identical.

Hereinafter, the principle of achieving the current-sharing purpose by the current-sharing transformer 5 will be illustrated in more details with reference to FIG. 5. When the power supply circuit is enabled, an AC voltage outputted from the switching circuit is transmitted to the primary winding coil 222 of the current-sharing transformer 5. Meanwhile, the main magnetic post 225 has a first magnetic flux density, the first minor magnetic post 226 has a second magnetic flux density, the second minor magnetic post 227 has a third magnetic flux density, the third minor magnetic post 53 has a fourth magnetic flux density and the fourth minor magnetic post 54 has a fifth magnetic flux density. Since the first magnetic path between the first minor magnetic post 226 and the main magnetic post 225, the second magnetic path between the second minor magnetic post 227 and the main magnetic post 225, the third magnetic path between the third minor magnetic post 53 and the main magnetic post 225 and the fourth magnetic path between fourth minor magnetic post 54 and the main magnetic post 225 are identical, each of the second magnetic flux density, the third magnetic flux density, the fourth magnetic flux density and the fifth magnetic flux density is equal to one fourth of the first magnetic flux density. As previously described, the first magnetic path between the first minor magnetic post 226 and the main magnetic post 225, the second magnetic path between the second minor magnetic post 227 and the main magnetic post 225, the third magnetic path between the third minor magnetic post 53 and the main magnetic post 225 and the fourth magnetic path between fourth minor magnetic post 54 and the main magnetic post 225 are identical. In addition, the coil turns of the first secondary winding coil 223, the second secondary winding coil 224, the third secondary winding coil 51 and the fourth secondary winding coil 52 are identical. According to Ampere's circuital law and Ohm's law, the AC induction currents outputted from he coil turns of the first secondary winding coil 223, the second secondary winding coil 224, the third secondary winding coil 51 and the fourth secondary winding coil 52 are equal. Since the DC currents passing through the LED strings are balanced by the current-sharing transformer 5, all LED strings have the same brightness value.

Since the magnetic paths between respective minor magnetic posts and the main magnetic post are equal, the magnitudes of currents passing through the DC loads are balanced by the current-sharing transformer. The number of the minor magnetic posts is the same as the number of the secondary winding coils, so that the DC currents passing through the respective DC loads are balanced by the current-sharing transformer. The configuration and shape of the current-sharing transformer are not restricted as long as the magnetic paths between respective minor magnetic posts and the main magnetic post are equal and the current-sharing purpose is achieved.

From the above description, since the magnetic paths between respective secondary winding coils and the primary winding coil of the current-sharing transformer are equal, the DC currents passing through the respective DC loads are balanced by the current-sharing transformer. Since no additional feedback and control circuits are necessary, the power supply circuit of the present invention is simplified and cost-effective.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A current-sharing transformer comprising:

a magnetic core assembly comprising a main magnetic post and multiple minor magnetic posts;

a primary winding coil wound around said main magnetic post; and multiple secondary winding coils wound around respective minor magnetic posts, wherein said secondary winding coils are connected to respective DC loads through respective rectifier circuits, wherein magnetic paths between respective minor magnetic posts and said main magnetic post are equal, so that the magnitudes of currents passing through said DC loads are balanced by said current-sharing transformer.

2. The current-sharing transformer according to claim 1 wherein each of said rectifier circuit comprises at least one diode.

3. The current-sharing transformer according to claim 1 wherein said DC loads are LED strings, and each LED string includes at least a LED.

4. The current-sharing transformer according to claim 1 wherein the coil turns of said secondary winding coils are identical.

5. The current-sharing transformer according to claim 4 wherein said multiple minor magnetic posts comprise a first minor magnetic post and a second minor magnetic post, which are symmetrically arranged at bilateral sides of said main magnetic post, so that a first spacing interval between said first minor magnetic post and said main magnetic post is equal to a second spacing interval between said second minor magnetic post and said main magnetic post.

6. The current-sharing transformer according to claim 5 wherein said first minor magnetic post and said second minor magnetic post have identical length and magnetic flux cross-section area, so that the average length and average magnetic flux cross-section area of said first minor magnetic post and said main magnetic post are equal to those of said second minor magnetic post and said main magnetic post.

7. The current-sharing transformer according to claim 5 wherein said main magnetic post, said first minor magnetic post and said second minor magnetic post are integrally formed.

8. The current-sharing transformer according to claim 6 wherein said multiple minor magnetic posts further comprise a third minor magnetic post and a fourth minor magnetic post, which are symmetrically arranged at bilateral sides of said main magnetic post, so that a third spacing interval between said third minor magnetic post and said main magnetic post is equal to a fourth spacing interval between said fourth minor magnetic post and said main magnetic post.

9. The current-sharing transformer according to claim 8 wherein said third minor magnetic post and said fourth minor magnetic post have identical length and magnetic flux cross-section area, so that the average length and average magnetic flux cross-section area of said third minor magnetic post and said main magnetic post are equal to those of said fourth minor magnetic post and said main magnetic post.

10. The current-sharing transformer according to claim 9 wherein the average length of the magnetic path between said third minor magnetic post or said fourth minor magnetic post and said main magnetic post is greater than the average length of magnetic path between said first minor magnetic post or said second minor magnetic post and said main magnetic post.

11. The current-sharing transformer according to claim 10 wherein the magnetic flux cross-section area of said third minor magnetic post or said fourth minor magnetic post is greater than the magnetic flux cross-section area of said first minor magnetic post or said second minor magnetic post, so that the average magnetic flux cross-section area of the magnetic path between said third minor magnetic post or said fourth minor magnetic post and said main magnetic post is greater than the average magnetic flux cross-section area of the magnetic path between said first minor magnetic post or said second minor magnetic post and said main magnetic post.

12. The current-sharing transformer according to claim 11 wherein the magnetic flux cross-section area of said third minor magnetic post or said fourth minor magnetic post is in direct proportion to the difference between the magnetic path length from said third minor magnetic post to said main magnetic post and the magnetic path length from said first minor magnetic post to said main magnetic post, or in direct proportion to the difference between the magnetic path length from said fourth minor magnetic post to said main magnetic post and the magnetic path length from said second minor magnetic post to said main magnetic post.

13. The current-sharing transformer according to claim 8 wherein the lengths of said first minor magnetic post, said second minor magnetic post, said third minor magnetic post and said fourth minor magnetic post are equal.

14. The current-sharing transformer according to claim 8 wherein said first minor magnetic post is arranged between said main magnetic post and said third minor magnetic post, and said second minor magnetic post is arranged between said main magnetic post and said fourth minor magnetic post.

15. The current-sharing transformer according to claim 8 wherein said main magnetic post, said first minor magnetic post, said second minor magnetic post, said third minor magnetic post and said fourth minor magnetic post are integrally formed.

16. A power supply circuit for driving multiple DC loads, said power supply circuit comprising:

a switching circuit for outputting an AC voltage;

a current-sharing transformer electrically connected to said switching circuit, and comprising:

a magnetic core assembly comprising a main magnetic post and multiple minor magnetic posts;

a primary winding coil wound around said main magnetic post and electrically connected with said switching circuit for receiving said AC voltage; and multiple secondary winding coils wound around respective minor magnetic posts, wherein said secondary winding coils generate AC induction currents according to electromagnetic induction between respective winding coils and said primary winding coil; and multiple rectifier circuits electrically connected to respective secondary winding coils and respective DC loads for rectifying said AC induction currents into corresponding DC voltages and outputting said DC voltages to respective DC loads, wherein magnetic paths between respective minor magnetic posts and said main magnetic post are equal, so that the magnitudes of currents passing through said DC loads are balanced by said current-sharing transformer.

17. The power supply circuit according to claim 16 wherein said switching circuit further comprises:

a switch element;

an isolation transformer for receiving an input voltage and outputting said AC voltage according to actions of said switch element.

18. The power supply circuit according to claim 16 wherein each of said rectifier circuits comprises at least one diode.

19. The power supply circuit according to claim 16 further comprising multiple filtering circuits, which are serially connected between said rectifier circuits and respective DC loads.

20. The power supply circuit according to claim 19 wherein each of said filtering circuits includes an inductor.

* * * * *